US012408742B1

(12) United States Patent
Kwong

(10) Patent No.: US 12,408,742 B1
(45) Date of Patent: Sep. 9, 2025

(54) CARD HOLDER

(71) Applicant: Evan Kwong, Monterey Park, CA (US)

(72) Inventor: Evan Kwong, Monterey Park, CA (US)

( * ) Notice: Subject to any disclaimer, the term of this patent is extended or adjusted under 35 U.S.C. 154(b) by 0 days.

(21) Appl. No.: 18/909,620

(22) Filed: Oct. 8, 2024

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/147
See application file for complete search history.

(56) References Cited

U.S. PATENT DOCUMENTS 4,316,539 A * 2/1982 Torrington ..... G11B 23/0328 206/307
5,592,767 A * 1/1997 Treske ..... G09F 3/207 24/3.12
6,592,003 B2 * 7/2003 Silverthorne ..... B65D 83/12 221/60
7,267,147 B2 * 9/2007 Tiscione ..... A45C 11/182 150/147
7,617,928 B1 * 11/2009 Murphy ..... B65D 83/12 206/39
D637,232 S * 5/2011 Ringl ..... D19/86
9,125,465 B2 * 9/2015 Beckley ..... A45C 11/182
10,470,541 B2 11/2019 Moon
10,791,808 B2 * 10/2020 Kane ..... A45C 1/06
11,571,050 B2 * 2/2023 Tran ..... A45C 1/06
2006/0076094 A1 * 4/2006 Kaminski ..... G09F 3/20 40/658
2015/0034525 A1 * 2/2015 Braxton ..... A45C 11/182 206/555
2016/0045006 A1 * 2/2016 Moon ..... A45C 11/182 150/149
2018/0368547 A1 * 12/2018 Grannan ..... A45C 11/182
2023/0218053 A1 * 7/2023 Mayer ..... A45C 1/06 150/131

FOREIGN PATENT DOCUMENTS

CN 219088582 U 5/2023
WO WO-2020114654 A1 * 6/2020 ..... A45C 11/182

* cited by examiner

*Primary Examiner* — Nathan J Jenness
*Assistant Examiner* — Justin Caudill
(74) *Attorney, Agent, or Firm* — Jose Cherson Weissbrot

(57) ABSTRACT

The present disclosure proposes a card holder, including: a connecting portion extending in a first lateral direction; and two holding portions respectively arranged on two sides of the connecting portion in a length direction, wherein a first end of each of the holding portions in a length direction is connected to an end of the holding portion in the length direction, the two holding portions and the connecting portion enclose a card slot, the card slot being configured to mate with a card, the holding portions are arranged obliquely toward a center line of the card slot in a second lateral direction, and the holding portions are each a structure made of an elastic material.

12 Claims, 3 Drawing Sheets

CARD HOLDER

TECHNICAL FIELD

The present disclosure relates to the technical field of holders, and in particular to a card holder.

BACKGROUND ART

A card holder is a structure for storing and placing bank cards, bus cards, identity cards, driver's license cards, shopping cards, employee ID cards, meal cards, identification cards, etc.

Chinese Patent Publication No. CN 219088582 U discloses a card holder which allows for multi-directional insertion, which is hereby incorporated herein by reference in its entirety, the card holder including a body, Atop face of the body is provided with a positioning slot adapted to an external card, four edges of an opening of the positioning slot are each provided with a limiting block extending into the positioning slot, an engagement slot adapted to the thickness of the external card is formed between each limiting block and the bottom of the positioning slot, a top face of each limiting block is provided with a step position, a distance between each engagement slot and a side face of the opposite limiting block is less than the length or the width of the external card, and a bottom face of the body is provided with an adhesive layer. Although the card holder is capable of receiving and placing a card by means of the positioning slot, the positioning slot is a structure having only one side opening, and the card holder thus has a large weight and consumes more material.

U.S. Patent Publication No. U.S. Ser. No. 10/470,541 B2 discloses a card wallet including a base and two holding arms arranged on two sides of the base in a length direction which is hereby incorporated herein by reference in its entirety. Inner ends of the holding arms are connected to ends of the base, the two holding arms and the base enclose a retention area for mating with a card to restrain the card to the card wallet, and outer ends of the holding arms each have a limiting protrusion. The limiting protrusion is configured to protrude in a direction approaching the retention area, and the limiting protrusion is used to limit the card from being laterally detached from the retention area. The card wallet can retain the card within the retention area, but since the two holding arms are arranged in parallel, the holding arms arranged in parallel apply a small clamping force on the card, resulting in that the card cannot be retained to the card wallet.

SUMMARY OF THE INVENTION

An embodiment of the present disclosure provides a card holder, in order to solve the problems existing in related art. The technical solution thereof is described as follows.

An embodiment of the present disclosure provides a card holder, including:

a connecting portion extending in a first lateral direction; and two holding portions respectively arranged on two sides of the connecting portion in a length direction, wherein a first end of each of the holding portions in a length direction is connected to an end of the holding portion in the length direction, the two holding portions and the connecting portion enclose a card slot, the card slot being configured to mate with a card so as to limit the card in the card holder, and second ends of the two holding portions are spaced apart from each other and enclose an access opening, the access opening being in communication with the card slot and configured to allow the card to enter and exit the card slot;

the holding portions are arranged obliquely toward a center line of the card slot in a second lateral direction perpendicular to the first lateral direction such that a size of the access opening is smaller than a width of the card slot in the first lateral direction, and the holding portions are each a structure made of an elastic material to enable the holding portions to move in a direction away from the center line of the card slot in the second lateral direction during insertion of the card into the card slot through the access opening; and when the card mates with the card slot, the holding portions are still arranged obliquely toward the center line of the card slot in the second lateral direction, or the holding portions are parallel to the center line of the card slot in the second lateral direction, so as to increase clamping forces applied by the holding portions on the card.

The above description is merely presented for the purpose of the specification, and is not intended to limit the present disclosure in any way. In addition to the above illustrative aspects, implementations and features, further aspects, implementations and features of the present disclosure will become readily apparent with reference to the accompanying drawings and the following detailed description.

BRIEF DESCRIPTION OF THE DRAWINGS

In figures, the same reference signs denote the same or similar components or elements throughout multiple figures unless otherwise specified. These figures are not necessarily drawn to scale. It should be understood that these accompanying drawings depict only some implementations disclosed in the present disclosure and should not be construed as limiting the scope of the present disclosure.

LIST OF REFERENCE SIGNS

1. Connecting portion; 2. Holding portion; 21. Holding plate; 211. Limiting protrusion; 2111. First mounting guide slope; 2112. Second mounting guide slope; 2113. First arc portion; 22. Limiting plate; 221. Fourth arc portion; 23. Guide groove; 24. Second arc portion; 3. Card slot; 4. Access opening; 5. Third arc portion; 6. Opening.

DETAILED DESCRIPTION OF EMBODIMENTS

Only some exemplary embodiments will be briefly described below. As can be appreciated by those skilled in the art, modifications may be made to the described embodiments in various ways without departing from the spirit or scope of the present disclosure. Therefore, the drawings and the description are considered as exemplary in nature rather than limiting.

Figure 1:
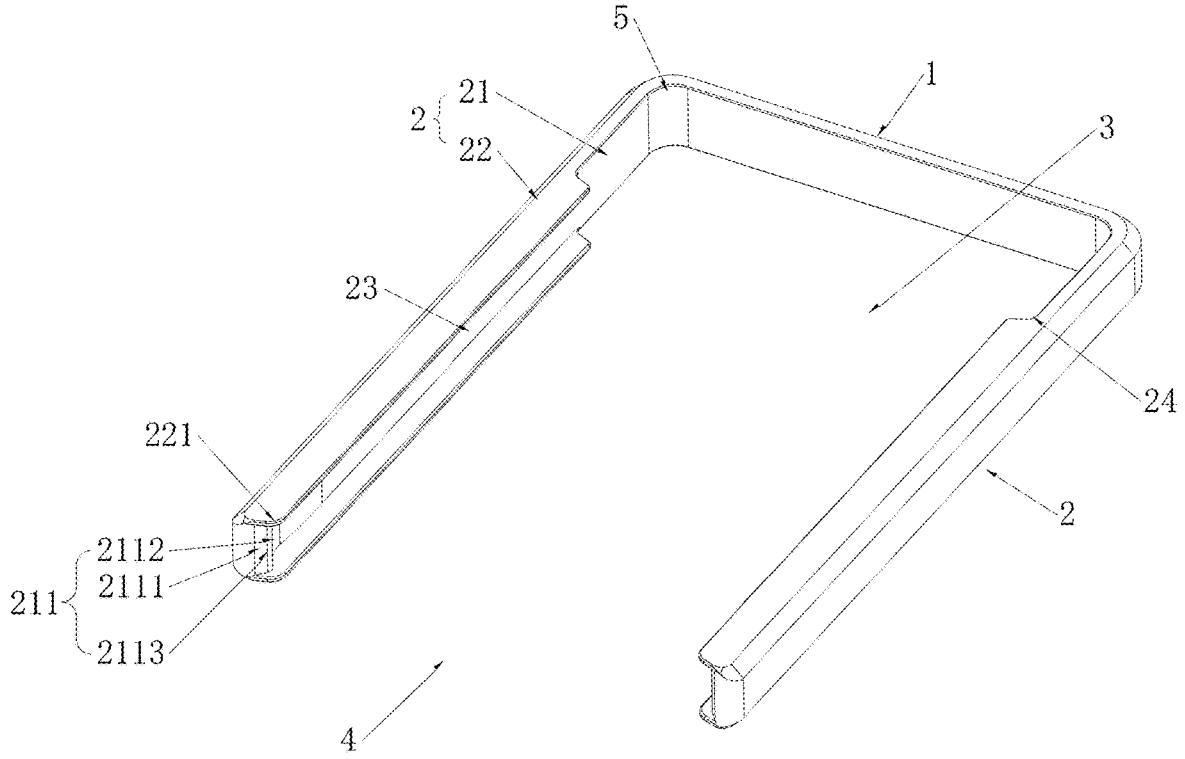
FIG. 1 is a schematic perspective structural diagram of a card holder of the present invention from a first perspective.
Figure 2:
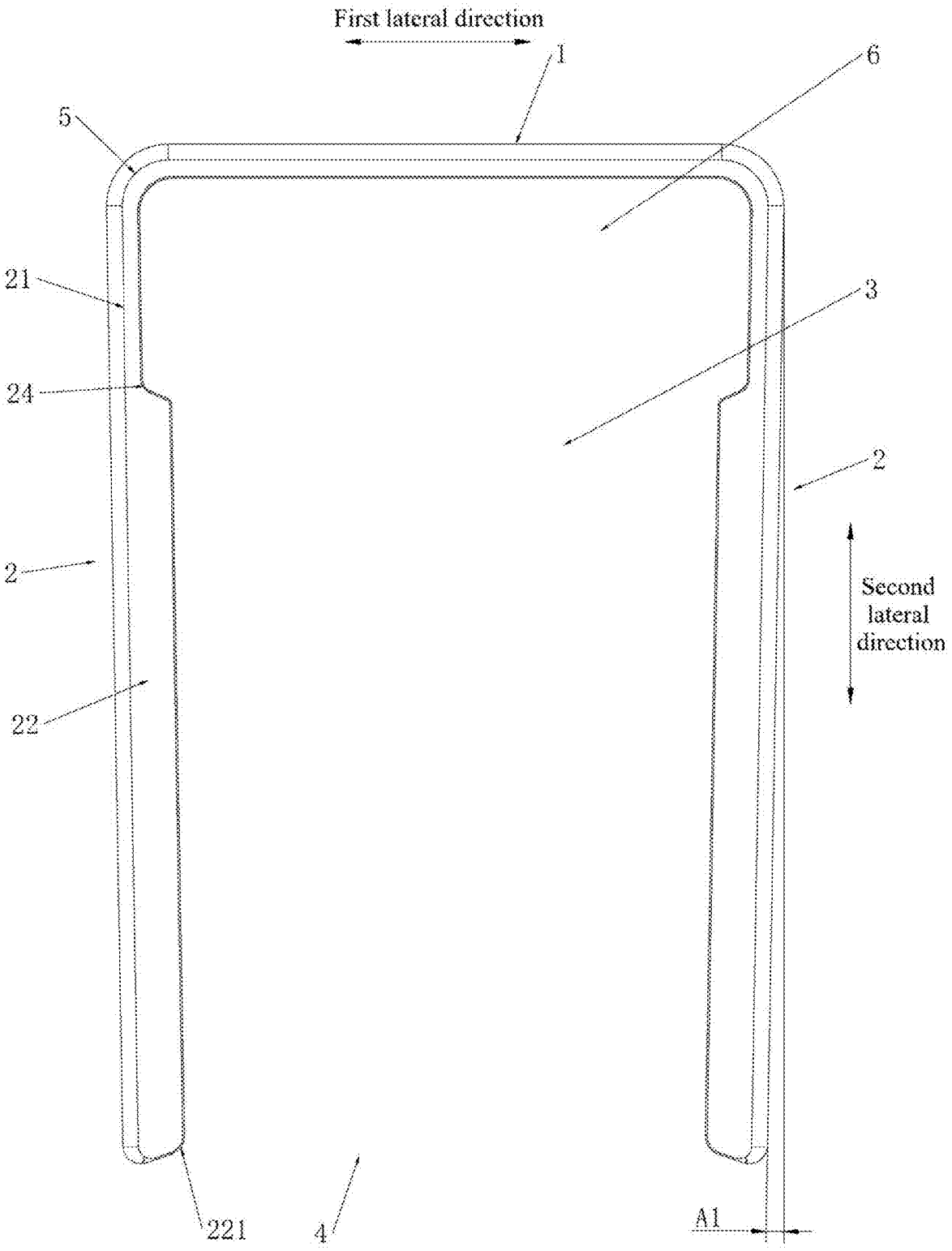
FIG. 2 is a schematic perspective structural diagram of the card holder of the present invention from a second perspective.
Figure 3:
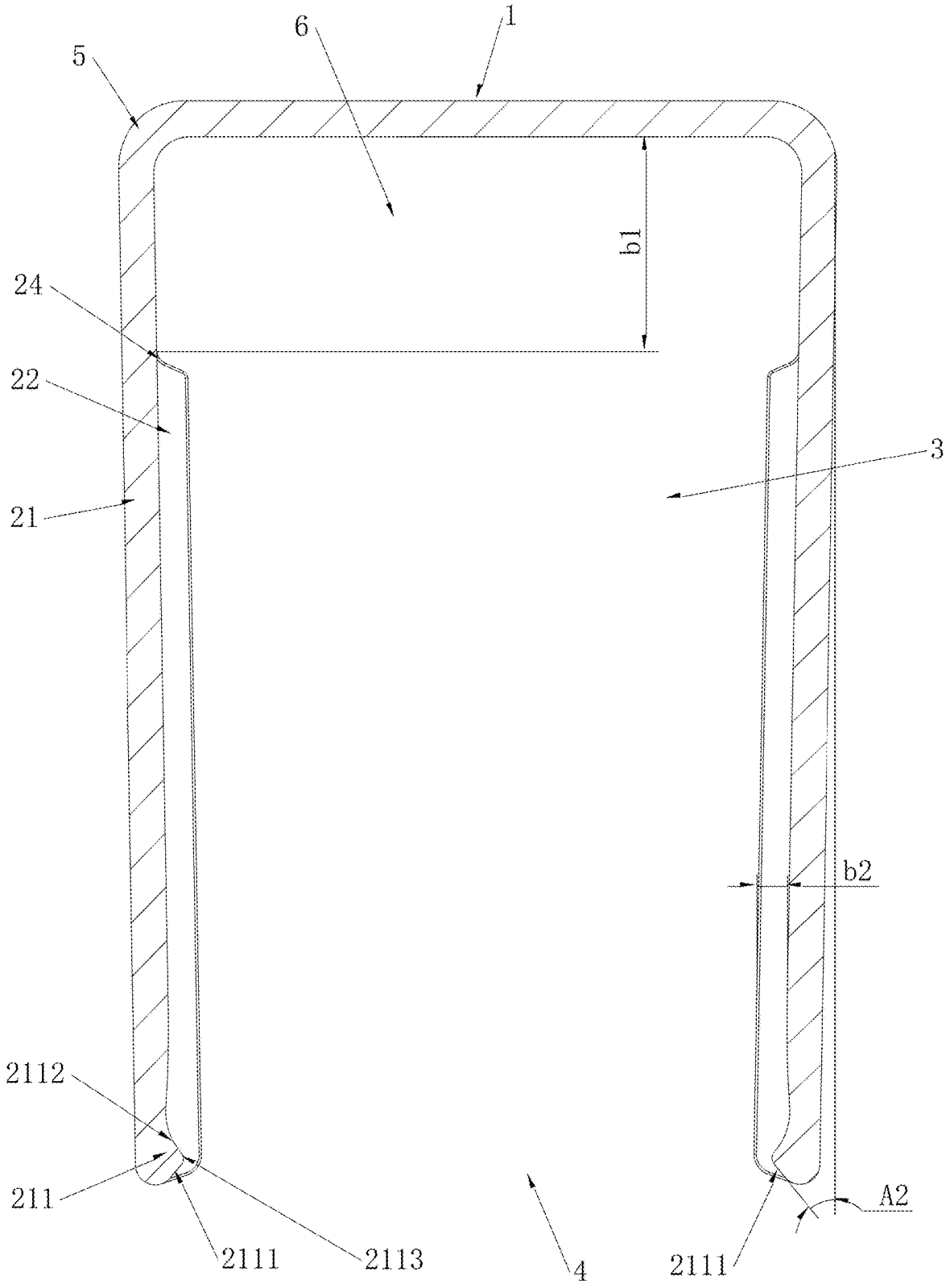
FIG. 3 is a cross-sectional view of the card holder of the present invention from the second perspective.

Referring to FIGS. 1-3, a card holder according to a preferred implementation of the present invention is shown. The card holder includes:

a connecting portion 1, the connecting portion 1 extending in a first lateral direction; and two holding portions 2, the two holding portions 2 being respectively arranged on two sides of the connecting portion 1 in a length direction. A first end of each of the holding portions 2 in a length direction is connected to an end of the holding portion 2 in the length direction, the two holding portions 2 and the connecting portion 1 enclose a card slot 3, the card slot 3 being configured to mate with a card so as to limit the card in the card holder, and second ends of the two holding portions 2 are spaced apart from each other and enclose an access opening 4. The access opening 4 is in communication with the card slot 3, and the access opening 4 is configured to allow the card to enter and exit the card slot 3. An opening 6 at an end of the card slot 3 away from the access opening 4 is in communication with the card slot 3, and the opening 6 is configured to allow the card to enter and exit the card slot 3.

The holding portions 2 are arranged obliquely toward a center line of the card slot 3 in a second lateral direction perpendicular to the first lateral direction such that a size of the access opening 4 is smaller than a width of the card slot 3 in the first lateral direction, and the holding portions 2 are each a structure made of an elastic material to enable the holding portions 2 to move in a direction away from the center line of the card slot 3 in the second lateral direction during insertion of the card into the card slot 3 through the access opening 4; and when the card mates with the card slot 3, the holding portions 2 are still arranged obliquely toward the center line of the card slot 3 in the second lateral direction, or the holding portions 2 are arranged parallel to the center line of the card slot 3 in the second lateral direction, so as to increase clamping forces applied by the holding portions 2 on the card.

In the card holder of the present invention, based on the fact that the holding portions 2 are arranged obliquely toward the center line of the card slot 3 in the second lateral direction such that the size of the access opening 4 is smaller than the width of the card slot 3 in the first lateral direction, that is, the holding portions 2 are deformed inwardly so that the two holding portions 2 are not parallel to each other, and when the card mates with the card slot 3, the holding portions 2 are still arranged obliquely toward the center line of the card slot 3 in the second lateral direction, or the holding portions 2 are arranged parallel to the center line of the card slot 3 in the second lateral direction, so as to increase clamping forces applied by the holding portions 2 on the card, the card can be retained very firmly by the two holding portions 2, the reliable retention of the card in the card slot 3 is achieved, the accidental detachment of the card from the card slot 3 can be effectively avoided, and the connection reliability is higher. Moreover, based on the fact that the holding portions 2 are each a structure made of an elastic material to enable the holding portions 2 to move in the direction away from the center line of the card slot 3 in the second lateral direction during insertion of the card into the card slot 3 through the access opening 4, that is, to move the holding portions 2 horizontally outwardly, the holding portions 2 can be deformed uniformly, ensuring that the card can be inserted and removed easily, and that the card can be retained very firmly.

It can be understood that the card refers to an identity card, a bank debit card, a credit card, a driver's license, and any mechanical and/or electronic device that exists or will be developed in the future, which approximates the general profile of a traditional credit card such as an RFID card.

It can be understood that the thickness of the card slot 3 may be suitable in particular for holding one card, or for holding two cards, or to holding three or more cards, and can be set according to actual requirements.

Referring to FIG. 2, in an implementation, an included angle between the holding portion 2 and the center line of the card slot 3 in the second lateral direction is A1, where $0° < A1 \leq 2°$. By setting the included angle between the holding portion 2 and the center line of the card slot 3 in the second lateral direction to be 0°-2°, it is possible to ensure that the holding portion 2 can apply a large clamping force on the card, and also to make the card easy to enter and exit the card slot 3, thereby reducing the difficulty of inserting and removing the card and improving ease of use.

In an implementation, the holding portion 2 is a structure made of a medium-hardness metal material or a high-hardness plastic material. The medium-hardness metal material and the high-hardness plastic material are both slightly elastic materials, so that the holding portion 2 has slightly elastic properties, ensuring that the holding portion 2 is uniformly deformed. Moreover, it is also possible to enable the holding portion 2 to apply a large clamping force on the card to reliably clamp the card, and also to make the card easy to insert and remove, so that the difficulty of inserting and removing the card can be reduced, thereby killing three birds with one stone.

In an implementation, the medium-hardness metal material is any one of aluminum, titanium, and magnesium, and the high-hardness plastic material is ABS (a thermoplastic polymeric material). The aluminum, titanium, magnesium and ABS have advantages of high strength and good toughness, not only can the holding portion 2 have better slightly elastic properties, but the structural strength of the holding portion 2 can be also increased, thereby ensuring that the holding portion 2 can reliably clamp the card.

Referring to FIGS. 1 and 3, in an implementation, a limiting protrusion 211 and a first mounting guide slope 2111 are provided at the second end of the holding portion 2. The limiting protrusion 211 is located between the card slot 3 and the access opening 4, and the limiting protrusion 211 is configured to abut against the card so as to limit the card in the card slot 3. The first mounting guide slope 2111 is arranged on the limiting protrusion 211, the first mounting guide slope 2111 is located on a side close to the access opening 4, and the first mounting guide slope 2111 is configured to slidably mate with a side portion of the card so as to guide the insertion of the card into the card slot 3. In this way, during insertion of the card into the card slot 3, the side portion of the card slides on the first mounting guide slope 2111 so as to enable the card to be guided into the card slot 3 smoothly, so that the insertion difficulty of the card can be reduced, and it is possible to quickly insert the card into the card slot 3, with high insertion efficiency, while making the insertion of the card less labor-intensive. In addition, the card located in the card slot 3 can be limited by the limiting protrusions 211 to prevent the card from accidentally detaching from the card slot 3 through the access opening 4, so that the card can be reliably retained in the card slot 3, improving the connection stability.

Referring to FIG. 3, in an implementation, an included angle between the first mounting guide slope 2111 and the second lateral direction is A2, where $20° \leq A2 \leq 50°$. The first mounting guide slope 2111 at this angle can allow the card to be inserted into the card slot 3 more quickly and easily, which helps to further reduce the insertion difficulty of the card, so that the card can be inserted into the card slot 3 by applying less force on the card, making the insertion of the card less labor-intensive.

Referring to FIGS. 1 and 3, in an implementation, a second mounting guide slope 2112 is further provided at the second end of the holding portion 2. The second mounting guide slope 2112 is arranged on the limiting protrusion 211, the second mounting guide slope 2112 is located on a side close to the card slot 3, and the second mounting guide slope 2112 is configured to slidably mate with the card so as to guide detachment of the card from the card slot 3. In this way, during removal of the card into the card slot 3, the side portion of the card slides on the second mounting guide slope 2112 so as to enable the card to be guided out of the card slot 3 smoothly, so that the removal difficulty of the card can be reduced, and it is possible to quickly remove the card, with high removal efficiency, while making the removal of the card less labor-intensive.

Referring to FIG. 3, in an implementation, the limiting protrusion 211 is further provided with a first arc portion 2113. The first arc portion 2113 is arranged to protrude in a direction approaching the center line of the card slot 3 in the second lateral direction, and the first arc portion 2113 is connected to the first mounting guide slope 2111 and the second mounting guide slope 2112 to make insertion or removal of the card smoother and less labor-intensive.

In an implementation, the radius of the first arc portion 2113 is d, where 5 mm d 7 mm. The mechanical lever effect can be fully utilized by controlling the radius of the first arc portion 2113 within the range of 5 mm to 7 mm. The elastic force of the holding portion 2 can be overcome by applying a small force to the card in an initial stage of insertion of the card, so that the insertion of the card is made less labor-intensive, and the insertion difficulty of the card is reduced. Moreover, the elastic force of the holding portion 2 can be overcome by applying a small force to the card in an initial stage of removal of the card, so that the removal of the card is made less labor-intensive, and the removal difficulty of the card is reduced.

In an implementation, A2=35°, and d=5 mm. The mechanical leverage ratio of the limiting protrusion 211 under this size is 1 to 1.5, where 1 represents that the card moves horizontally by a unit distance, and 1.5 represents that the holding portion 2 moves vertically by a unit distance. The radius of 5 mm is to gradually change the magnitude of the force so that only a small force is required during the initial insertion, ensuring that the card can be inserted more easily. The longer the horizontal movement distance of the card, the greater the clamping force, and the required force will gradually increase.

Referring to FIG. 3, in an implementation, the opening 6 at an end of the card slot 3 away from the access opening 4 has a depth of b1, where 16.5 mm≤b1≤25 mm. By setting the depth of the opening 6 at the end of the card slot 3 away from the access opening 4 to 16.5 mm to 25 mm, it reduces the insertion difficulty of the card from the opening 6, makes the insertion of the card less labor-intensive, and effectively avoids damage to a surface of the card. Moreover, it is also possible for the holding portion 2 to hold the card reliably, so as to prevent the card from falling off.

In an implementation, b1=18 mm. By setting the depth of the opening 6 to 18 mm, it reduces the insertion difficulty of the card from the opening 6, makes the insertion of the card less labor-intensive, and effectively avoids damage to a surface of the card. Moreover, it is also possible for the holding portion 2 to hold the card reliably, so as to prevent the card from falling off.

In other implementations, b1=16.5 mm, or 17 mm, or 19 mm, or 25 mm.

In an implementation, the connecting portion 1 and the holding portions 2 are formed thereon by integral molding. That is, the card holder is of an integral structure, so that the card holder has a high structural strength, and it is thus possible to further increase the holding reliability of the card. Moreover, the card holder of the integral structure does not need to be provided with a connecting structure (such as screws) to connect the connecting portion 1 to the holding portions 2, so that the structure is simplified, the cost of the card holder can be reduced, and the weight of the card holder can also be reduced, making the card holder easier to carry.

In an implementation, for the card holder, the card slot 3 and the access opening 4 are formed by using a keyway cutting tool with a diameter of 7.8 mm to 14 mm to subtract material.

Referring to FIG. 1, in an implementation, the card slot 3 includes two guide grooves 23. The guide grooves 23 are located on the holding portions 2. Each of the guide grooves 23 is configured to mate with a side portion of the card, the guide groove 23 extends in the length direction of the holding portion 2, and the guide groove 23 has a depth of b2 in a width direction of the holding portion 2, where 1.5 mm≤b2≤6.5 mm, so as to reliably retain the card in the card slot 3, preventing the card from vertically detaching from the card slot 3. Moreover, it is possible to reduce the area of the card that is covered by the holding portions 2 to increase the area of the card that is exposed to the card holder. Where the card is an identity card, the identity card can be displayed directly without removing the card from the card holder, and there is no need to take additional steps to remove the identity card. Where the card is an RFID card, the RFID card can be scanned without removing the RFID from the card holder, making it easier to use.

Referring to FIG. 1, in an implementation, the holding portion 2 includes:

a holding plate 21, a first end of the holding plate 21 in a length direction being connected to an end of the connecting portion 1 in the length direction, and the holding plate 21 being configured to abut against a side portion of the card to enable the card to be clamped; and two limiting plates 22, the two limiting plates 22 being respectively arranged on an upper side and a lower side of the holding plate 21, a first end of each of the limiting plates 22 in a length direction being arranged spaced apart from the connecting portion 1, and a second end of each of the limiting plates 22 in the length direction extending to be connected to a second end of the holding plate 21 in the length direction. That is, the two limiting plates 22 and the holding plate 21 define the guide groove 23. The holding portion 2 has a simple and practical structure and low processing difficulty, and consumes less material, so that the weight of the card holder can be further reduced, making the card holder easier to carry, and the cost of the card holder can also be further reduced.

Referring to FIGS. 2 and 3, in an implementation, a second arc portion 24 is provided between the first end of the limiting plate 22 in the length direction and the holding plate 21, and the second arc portion 24 is configured to reduce stress between the limiting plate 22 and the holding plate 21, to increase the structural strength of the holding portion 2, thereby ensuring that the holding portion 2 can apply a clamping force to the card for a relatively long time.

Referring to FIG. 2, in an implementation, a fourth arc portion 221 is provided at the second end of the limiting plate 22 in the length direction, and the fourth arc portion 221 is configured to protrude toward the access opening 4, so as to avoid forming a sharp corner at the second end of the limiting plate 22 in the length direction, so that the safety of use can be improved.

Referring to FIG. 1, in an implementation, the first end of the holding portion 2 in the length direction is connected to the end of the connecting portion 1 in the length direction via a third arc portion 5. The third arc portion 5 is configured to reduce stress between the holding portion 2 and the connecting portion 1, to increase the connection stability between the holding portion 2 and the connecting portion 1, thereby enhancing the structural strength of the holding portion 2, and ensuring that the holding portion 2 can apply a clamping force to the card for a relatively long time.

In the description of this specification, descriptions with reference to the terms such as "an embodiment", "some embodiments", "example", "specific example", or "some examples" mean that specific features, structures, materials, or characteristics described with reference to the embodiment or example are included in at least one embodiment or example of the present disclosure. Moreover, the specific features, structures, materials or characteristics described can be combined in any one or more embodiments or examples in any suitable manner. In addition, without any contradiction, those skilled in the art may incorporate and combine different embodiments or examples and features of the different embodiments or examples described in this specification.

In addition, the terms "first" and "second" are used for descriptive purposes only, and cannot be construed as indicating or implying relative importance or implicitly indicating the number of technical features indicated. Thus, the features defined with "first" and "second" may explicitly or implicitly include at least one of the features. In the description of the present disclosure, the meaning of "a plurality of" is two or more, unless explicitly and specifically defined otherwise.

The above descriptions are merely specific implementations of the present disclosure, but are not intended to limit the scope of protection of the present disclosure. Any variation or replacement readily figured out by those skilled in the art within the technical scope disclosed in the present disclosure shall fall within the scope of protection of the present disclosure. Therefore, the scope of protection of the present disclosure shall be subject to the scope of protection of the claims.

What is claimed:

1. A card holder, comprising:

a connecting portion extending in a first lateral direction; and two holding portions respectively arranged on two sides of the connecting portion in a length direction, the first lateral direction is the same as the length direction, a first end of one of the holding portions in a length direction of the holding portions is connected to one end of the connecting portion in the length direction of the connecting portion, and a first end of the other of the holding portions in the length direction of the holding portions is connected to the other end of the connecting portion in the length direction of the connecting portion, the two holding portions and the connecting portion enclose a card slot, the card slot being configured to mate with a card so as to limit the card in the card holder, and second ends of the two holding portions are spaced apart from each other and enclose an access opening, the access opening being in communication with the card slot and configured to allow the card to enter and exit the card slot;

the holding portions are arranged obliquely toward a center line of the card slot in a second lateral direction perpendicular to the first lateral direction such that a size of the access opening is smaller than a width of the card slot in the first lateral direction, the second lateral direction and the length direction of the connecting portion are perpendicular, and the holding portions are each a structure made of an elastic material to enable the holding portions to move in a direction away from the center line of the card slot in the second lateral direction during insertion of the card into the card slot through the access opening; and when the card mates with the card slot, the holding portions are still arranged obliquely toward the center line of the card slot in the second lateral direction, or the holding portions are arranged parallel to the center line of the card slot in the second lateral direction, so as to increase clamping forces applied by the holding portions on the card;

wherein a limiting protrusion and a first mounting guide slope are provided at each of the second ends of the holding portions, the limiting protrusion being located between the card slot and the access opening and configured to abut against the card so as to limit the card in the card slot, and the first mounting guide slope being arranged on the limiting protrusion, being located on a side close to the access opening, and being configured to slidably mate with a side portion of the card so as to guide the insertion of the card into the card slot;

wherein an included angle between the first mounting guide slope and the second lateral direction is A2, where $200 \leq A2 \leq 50°$;

wherein a second mounting guide slope is further provided at each of the second ends of the holding portions, the second mounting guide slope being arranged on the limiting protrusion, being located on a side close to the card slot, and being configured to slidably mate with the card so as to guide detachment of the card from the card slot;

wherein the limiting protrusion is further provided with a first arc portion, the first arc portion being arranged to protrude in a direction approaching the center line of the card slot in the second lateral direction, and the first arc portion being connected to the first mounting guide slope and the second mounting guide slope;

wherein the first arc portion has a radius of d, where $5\ mm \leq d \leq 7\ mm$.

2. The card holder according to claim 1, wherein an included angle between the holding portion and the center line of the card slot in the second lateral direction is A1, where $0° \leq A1 \leq 2°$.

3. The card holder according to claim 1, wherein the holding portion is a structure made of a medium-hardness metal material or a high-hardness plastic material.

4. The card holder according to claim 3, wherein the medium-hardness metal material is any one of aluminum, titanium and magnesium, and the high-hardness plastic material is ABS.

5. The card holder according to claim 1, wherein $A2=35°$, and $d=5$ mm.

6. The card holder according to claim 1, wherein an opening at an end of the card slot away from the access opening has a depth of b1, where $16.5\ mm \leq b1 \leq 25\ mm$.

7. The card holder according to claim 5, wherein b1=18 mm.

8. The card holder according to claim 1, wherein the connecting portion and the holding portions are integrally formed.

9. The card holder according to claim 1, wherein the card slot comprises two guide grooves respectively located on the holding portions, each of the guide grooves being configured to mate with a side portion of the card, extending in the length direction of the holding portion, and having a depth of b2 in a width direction of the holding portion, where 1.5 mm≤b2≤6.5 mm.

10. The card holder according to claim 1, wherein the holding portion comprises:

a holding plate, a first end of the holding plate in a length direction of the holding plate being connected to an end of the connecting portion in the length direction of the connecting portion, and the holding plate being configured to abut against a side portion of the card; and two limiting plates respectively arranged on an upper side and a lower side of the holding plate, a first end of each of the limiting plates in a length direction of the limiting plates being arranged spaced apart from the connecting portion, and a second end of each of the limiting plates in the length direction of the limiting plates extending to be connected to a second end of the holding plate in the length direction of the holding plate.

11. The card holder according to claim 10, wherein a second arc portion is provided between the first end of the limiting plate in the length direction of the limiting plate and the holding plate, and is configured to reduce stress between the limiting plate and the holding plate.

12. The card holder according to claim 10, wherein the first end of the holding portion in the length direction of the holding portion is connected to the end of the connecting portion in the length direction of the connecting portion via a third arc portion, the third arc portion being configured to reduce stress between the holding portion and the connecting portion.

* * * * *